United States Patent [19]

Marzili

[11] Patent Number: 4,668,039

[45] Date of Patent: May 26, 1987

[54] CONNECTOR FOR FLAT CABLE

[75] Inventor: Joseph C. Marzili, Palmyra, Pa.

[73] Assignee: AMP Incorporated, Harrisburg, Pa.

[21] Appl. No.: 809,621

[22] Filed: Dec. 16, 1985

[51] Int. Cl.[4] ..... H01R 11/20

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 4,068,912 | 1/1978 | Hudson et al. | 339/99 R |
| 4,143,935 | 3/1979 | Goodman et al. | 339/99 R |
| 4,145,103 | 3/1979 | Knowles | 339/99 R |
| 4,410,229 | 10/1983 | Stephenson | 339/99 R |
| 4,418,977 | 12/1983 | O'Shea | 339/99 R |
| 4,452,502 | 6/1984 | Forberg et al. | 339/97 P |
| 4,496,207 | 1/1985 | Ensminger | 339/99 R |
| 4,504,102 | 3/1985 | Wakuluk | 339/97 P |

*Primary Examiner*—E. Michael Combs

*Attorney, Agent, or Firm*—F. Brice Faller; David L. Smith

[57] ABSTRACT

Connector for flat cable utilizes a bipartite cover defining a first cable receiving passage between the parts so that the cover may be assembled to the cable before termination. Dovetail profiled panel upstanding from housing is received through cover to align parts so that a press is not necessary. Second cable receiving passage defined by panel and cover meets first passage at right angle to provide strain relief and permit tap terminations.

7 Claims, 6 Drawing Figures

CONNECTOR FOR FLAT CABLE

The present invention relates to an insulation displacing connector for mass terminating flat multiconductor cable, and particularly to a connector for field application without any special tooling.

BACKGROUND OF THE INVENTION

U.S. Pat. No. 4,496,207 discloses an electrical connector assembly for flat multiconductor cable, the assembly being of the type comprising an elongate housing having a cable terminating face, an opposed mating face, and opposed endwalls. The housing has a plurality of contacts therein, the contacts having respective conductor receiving portions extending from the mating face in parallel rows. The connector assembly further comprises an elongate cover assembly having latch arms at opposite ends thereof, the latch arms engaging the latch means to retain the cover assembly against the cable terminating face. The cover assembly has a first cable receiving passage therethrough, the passage being intersected by a plurality of apertures which receive respective conductor receiving portions therein, the passage being profiled to align the conductors of the cable with respective apertures.

In some applications, such as communication systems, it is sometimes desirable to tap a peripheral device into the cable of an existing system. However, the cover assembly of the above described connector is of integral construction, requiring that the end of the cable be fed through the first passage prior to termination. A tap connection is thus precluded when there are already connectors installed on the ends of the cable.

In order to prevent cocking or skewing of the cover assembly with respect to the housing during termination, which could result in misalignment of the cable with the conductor receiving portions of the contacts, connectors of the type described above are usually terminated with a press. However, a press is generally inconvenient for field use, as where a home intercom system is being installed or modified. Thus it would be desirable for such a connector to incorporate means for positively aligning the cover assembly with the housing, so that a simple field tool could be used to complete the termination.

SUMMARY OF THE INVENTION

According to the invention, therefore, the cover assembly is bipartite, comprising an upper part and a lower part which define the first cable receiving passage therebetween. The latch arms extend from the upper part through respective openings in the lower part to engage the housing, whereby the cover assembly may be assembled to the cable remote from the end of the cable.

According to another aspect of the invention, the housing is characterized by a panel upstanding from the cable terminating face parallel to the rows, the panel having an inner sidewall facing the rows, an opposed outer sidewall, and a pair of opposed ends proximate the ends of the housing, the cover assembly being profiled to closely receive the ends of the panel. The cover assembly and the inner sidewall of the panel are cooperable to define a second cable receiving passage therebetween, the second passage extending at a right angle to the first passage. A cable passing through both the first and second passages will thus be afforded strain relief.

DETAILED DESCRIPTION OF THE PREFERRED EMBODIMENT

Figure 1:
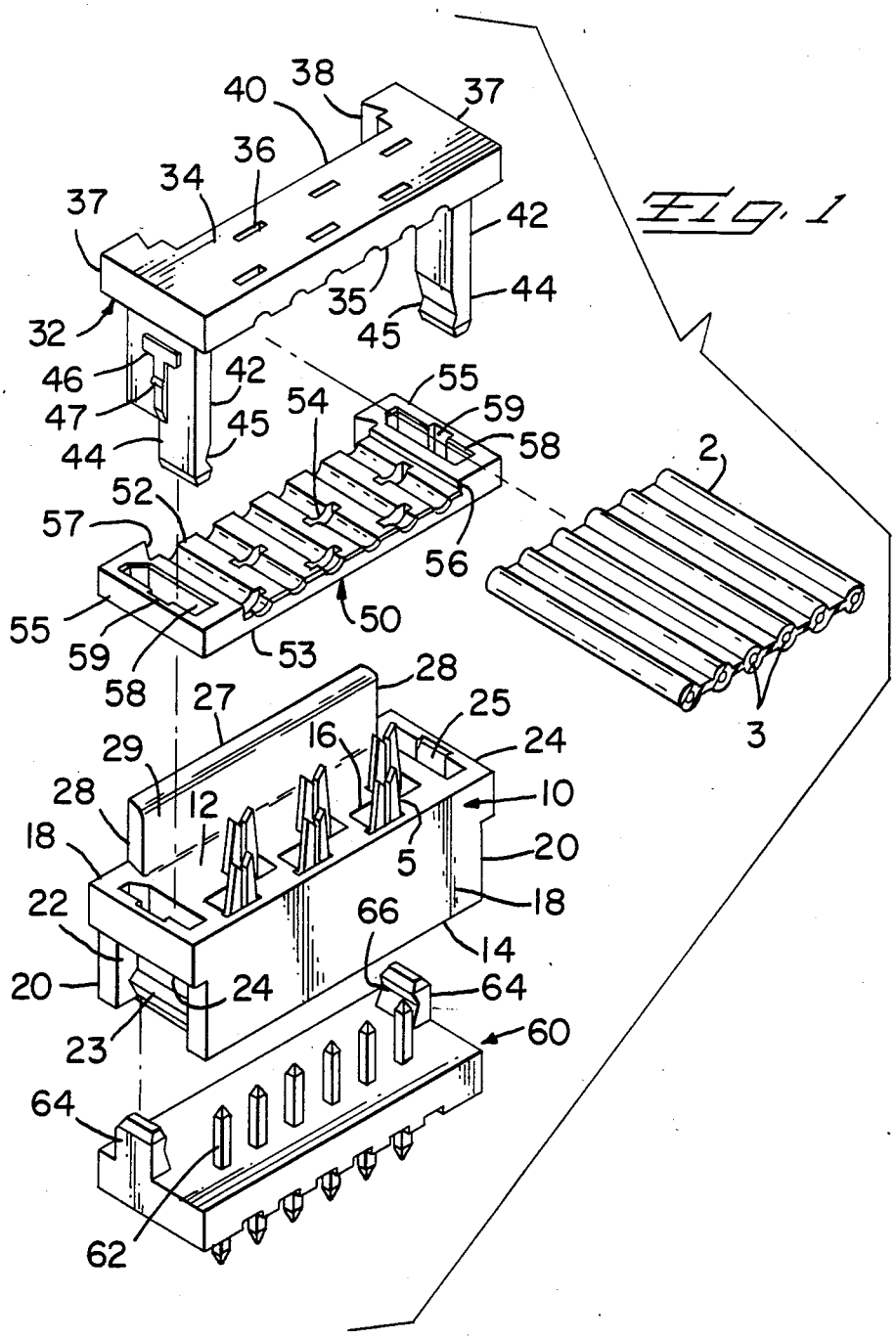
FIG. 1 is an exploded perspective.

Referring to FIG. 1, this embodiment of the inventive connector is for terminating a flat multiconductor ribbon cable 2 having conductors 3 spaced on 0.100 inch centerlines. A housing 10 molded of suitable thermoplastic comprises a cable receiving face 12, an opposed mating face 14, contact receiving passages 16 extending therebetween, a pair of opposed sidewalls 18, and a pair of opposed endwalls 20. The passages 16 receive electrical contacts having slotted plates 5 which extend from the cable receiving face 12 in two parallel rows. Each endwall 20 is profiled with a channel 22 extending between faces 12 and 14, each channel 22 having a rib 23 extending thereacross proximate the mating face 14 and a crossbar 24 bridging the channel at the cable terminating face 12. An integral panel 27 upstanding from face 12 has an inner sidewall 29 paralleling the rows of slotted plates 5 and opposed endwalls 28 which are bevelled to give the panel 27 a dovetail profile.

The cover assembly comprises an upper part 32 and a lower part 50, the upper part having a top surface 34, an opposed bottom surface 35, apertures 36 extending therebetween, and a pair of opposed ends 37. The upper part 32 is molded with a channel 38 profiled for close reception on ends 28 of the panel 27, the channel 38 having a subfloor 40 which leaves a second cable receiving passage between the inside surface 29 and the upper part 32. A pair of latch arms 42 extend from the bottom surface 35 adjacent respective ends 37, each latch arm 42 being fully as wide as a respective channel 22 in which it is received, except toward distal end 44, where the arm 42 is only about half the width of the channel 22. The inside surface of each arm 42 has a shallow V channel 45 profiled to engage a respective rib 23, the outside surface of each arm 42 having a T-shaped latch 46 with a detent 47 thereon. The lower part 50 has a top surface 52, an opposed bottom surface 53, apertures 54 extending therebetween, and a pair of opposed ends 55. The top surface 52 has a fluted channel 56 profiled to receive the cable 2 closely thereagainst, the upper part 32 and the lower part 50 defining a first cable receiving passage therebetween. A dovetail channel 57 closely receives the panel 27, while a pair of openings 58 adjacent respective ends 55 closely receive the arms 42, notches 59 permitting the passage of detents 47.

Referring still to FIG. 1, the connector assembly further comprises a header 60 intended for mounting on the peripheral device, a row of pins 62 being mated to contacts 4 inside housing 10. A pair of latch arms 64 upstanding from respective opposite ends of the header 60 have shallow V channels 66 profiled to engage respective ribs 23, each arm 64 and a respective distal end 44 of arm 42 collectively spanning the channel 22 in which they are received.

Figure 2:
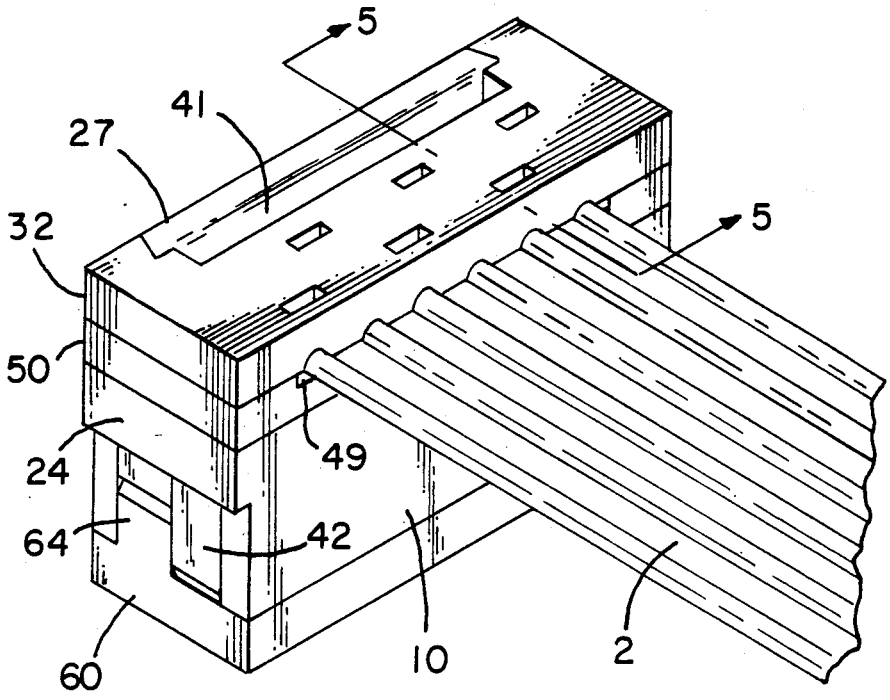
FIG. 2 is an assembled perspective.

The cable 2 is terminated by first assembling upper part 32 and lower part 50, the T latches 46 engaging the bottom surface 53. The cover assembly 32, 50 is then preassembled to housing 10 (FIG. 4), the cable 2 is fed into the first cable receiving passage as will be described, and the bottom surface 53 is pressed home against the cable terminating face 12 until the channels 45 engage ribs 23. During termination, the panel 27 is closely received in dovetail channels 52, 38, keeping the cover assembly properly aligned with the housing 10 so that conductors 3 are centrally received in slotted plates 5. After termination, the connector may be mated with the header 60 as shown in FIG. 2.

Figure 3:
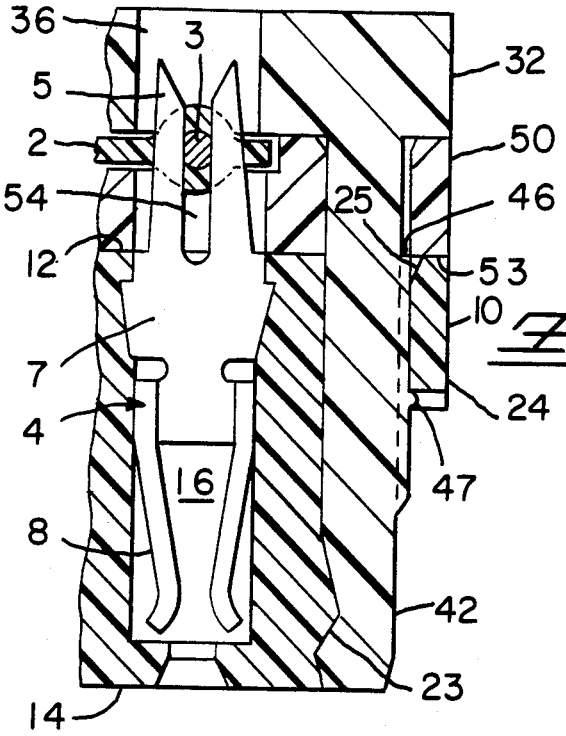
FIG. 3 is a partial side section of the connector.

Referring to FIG. 3, the contact 4 is held in housing 10 by retaining plate 7 interferingly received in passage 16. Cantilever arms 8 extend toward mating face 14 while the conductor receiving portion in the form of slotted plate 5 extends upward from terminating face 12 into apertures 36, 54 of respective cover parts 32, 50. The T latch 46 engages bottom surface 53 while the inside surface of arm 42 engages rib 23 to retain the components in assembled condition. While the detent 47 is shown engaged with crossbar 24, its primary function is to rest on top of crossbar 24 to maintain the preassembled configuration of FIG. 4. The ramped notch 25 facilitates passage of the detent 47 when termination force is applied.

Figure 4:
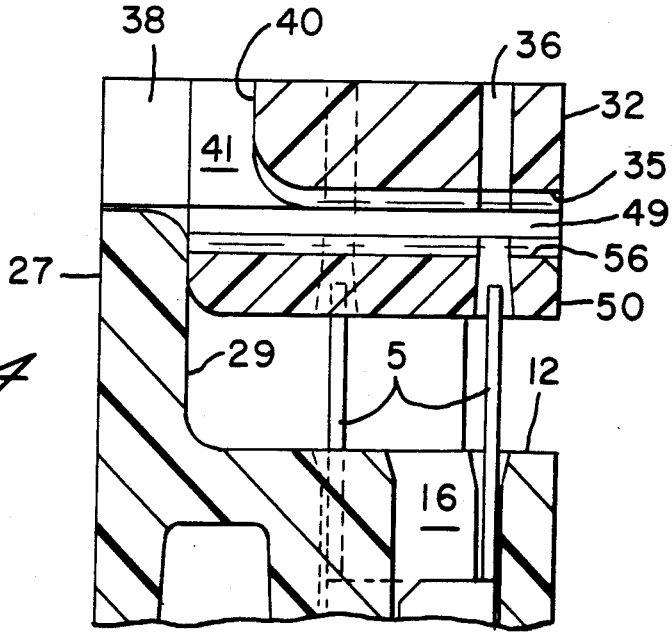
FIG. 4 is an end section of the preassembled connector.
Figure 5:
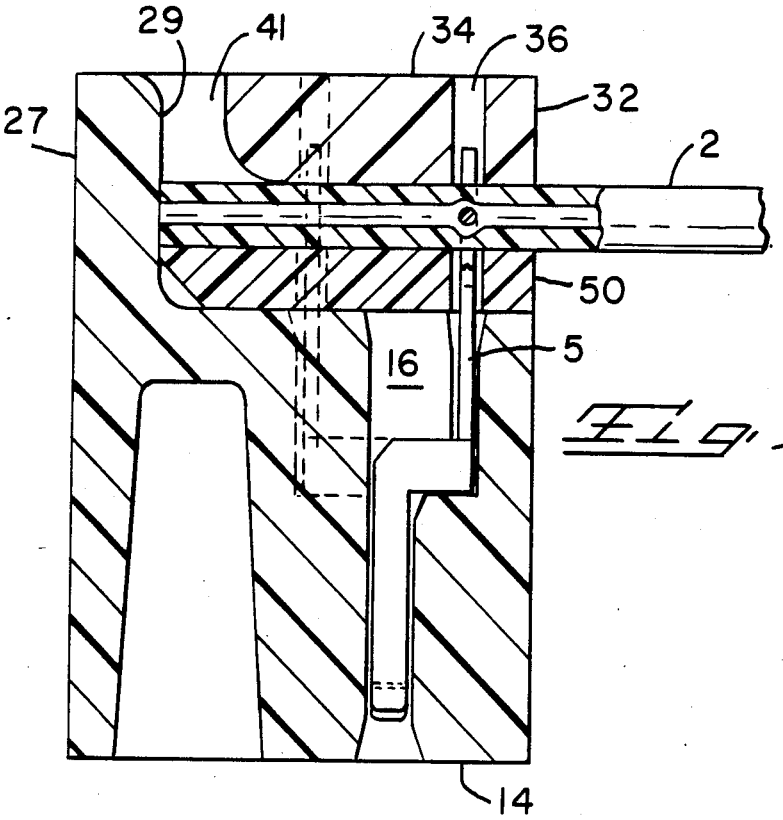
FIG. 5 is an end section of the connector with an end termination.
Figure 6:
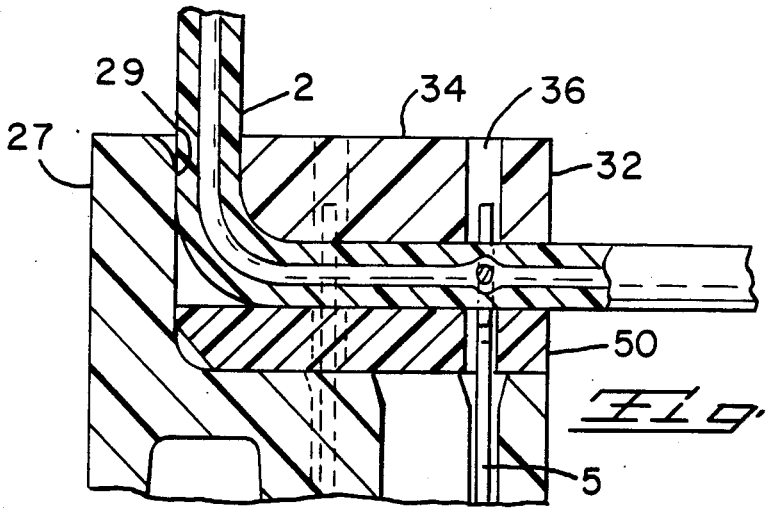
FIG. 6 is an end section of the connector with a tap termination.

Referring to FIG. 4, the formation of the first cable receiving passage 49 between bottom surface 35 and fluted channel 56 is apparent. In order to achieve an end termination, the cable is simply slid into passage 49 until it abuts the inside surface 29 of panel 27. The cable is then terminated by pressing the cover assembly 32, 50 to face 12, as shown in FIG. 5. If it is desired to terminate the cable remote from an end thereof, the cable is slid into passage 49 beyond where the end abuts inside surface 29 of panel 27 with the end of the cable passing over the rounded top edge of the panel 27 until the cover assembly is at the desired connector location on the cable; terminating the cable by pressing cover assembly 32, 50 to face 12 as the cover assembly is guided normal to face 12 by ends 28 of panel 27 will cause the cable to move into second cable receiving passage 41, as shown in FIG. 6. The right angle bend in the cable also lends a degree of strain relief to the termination. Thus, if strain relief for an end termination is desired, the cable 2 could be cut close to either top surface 34 or at the entry to the cable receiving passage defined by cover parts 32, 50. If it is desired to terminate the cable intermediate connectors which have already been applied, it will of course be necessary to apply the cover parts 32, 50 to the cable prior to the preassembly stage of FIG. 3.

The foregoing is exemplary and not intended to limit the scope of the claims which follow.

I claim:

1. An electrical connector assembly for terminating flat multiconductor cable comprising:

an elongate housing having a cable terminating face, an opposed mating face, and opposed endwalls having respective latch means thereon, a plurality of contacts in said housing, said contacts having respective conductor receiving portions extending from said cable terminating face in parallel rows, an elongate cover assembly having latch arms at opposite ends thereof, said latch arms engaging said latch means to retain said cover assembly along said cable terminating face, said cover assembly having a cable receiving passage therethrough, said passage being intersected by a plurality of apertures which receive respective conductor receiving portions of contacts, said passage being profiled to align conductors of the cable with respective apertures, said cover assembly having a rear surface, said electrical connector assembly characterized by a panel upstanding from said cable terminating face parallel to said rows of contacts to guide said cover assembly perpendicular to the cable terminating face to align and accurately engage the flat multiconductor cable with the rows of contacts, said panel having a pair of opposed ends proximate said endwalls of said housing, said cover assembly having channel means open to the rear surface, said channel means having adjacent first and second sections, said first section profiled to closely receive the ends of the panel therein to prevent said cover assembly from rotating or skewing relative to said cable terminating face of said housing, said second section remote from the rear surface and providing a passage through which the flat multiconductor cable passes.

2. A connector assembly as in claim 1 wherein said panel has a dovetail cross section to facilitate alignment of said cover assembly to said housing.

3. A connector assembly as in claim 1 further characterized in that said cover assembly is bipartite, comprising an upper part and a lower part which define said first cable receiving passage therebetween, said latch arms extending from said upper part through respective openings in said lower part to engage said housing, whereby said cover assembly may be assembled to said cable remote from the end thereof.

4. A connector assembly as in claim 1 wherein said housing has a channel in each endwall and extending perpendicularly to said cable terminating face, each channel closely receiving a latch arm therein, said latch means comprising a rib extending across each channel proximate said mating face, each latch arm having an inside surface which is profiled to engage a respective rib when the cable is terminated.

5. A connector assembly as in claim 4 further comprising an elongate header for mating against said mating face of said housing, said header having a latch arm upstanding from each opposed end thereof, said latch arms of said header likewise having inside surfaces profiled to engage respective ribs when said housing is mated to said header, each latch arm of said header and a respective latch arm of said cover assembly collectively spanning said channel where said arms engage the respective rib.

6. A connector assembly as in claim 1 wherein said housing has a channel in each endwall and extending perpendicularly to said cable terminating face, said channel being bridged by an integral cross bar proximate said cable terminating face, each said latch arm having a detent which engages said crossbar when said upper part, said lower part, and said housing are fully assembled.

7. A connector assembly as in claim 3 wherein each latch arm has a latch thereon, each latch engaging the lower part when the upper part and lower part are assembled.

* * * * *